United States Patent [19]

Imai et al.

[11] Patent Number: 4,684,561

[45] Date of Patent: Aug. 4, 1987

[54] COLOR SHEETS FOR THERMAL TRANSFER PRINTING

[75] Inventors: Akihiro Imai, Ikoma; Tokihiko Shimizu, Nara; Nobuyoshi Taguchi, Ikoma, all of Japan

[73] Assignee: Matsushita Electric Industrial Co., Ltd., Japan

[21] Appl. No.: 910,832

[22] Filed: Sep. 23, 1986

Related U.S. Application Data

[63] Continuation of Ser. No. 654,934, Sep. 27, 1984, abandoned.

[30] Foreign Application Priority Data

| | | | |
|---|---|---|---|
| Sep. 28, 1983 | [JP] | Japan | 58-181008 |
| Oct. 12, 1983 | [JP] | Japan | 58-190101 |
| Feb. 20, 1984 | [JP] | Japan | 59-30541 |
| Apr. 16, 1984 | [JP] | Japan | 59-76038 |
| Apr. 16, 1984 | [JP] | Japan | 59-76039 |

[51] Int. Cl.[4] ..... B41M 5/26

[52] U.S. Cl. ..... 428/141; 8/471; 428/143; 428/206; 428/323; 428/328; 428/329; 428/330; 428/331; 428/488.4; 428/500; 428/520; 428/522; 428/913

[58] Field of Search ..... 346/200, 226; 8/471; 428/141, 143, 144, 195, 204, 206, 207, 211, 323, 328–331, 409, 484, 488.1, 488.4, 500, 520, 522, 913, 914

[56] References Cited

U.S. PATENT DOCUMENTS

| | | | |
|---|---|---|---|
| 4,400,437 | 8/1983 | Oeda | 428/913 |
| 4,559,273 | 12/1985 | Kutsukake et al. | 428/913 |
| 4,572,860 | 2/1986 | Nakamura et al. | 428/914 |

FOREIGN PATENT DOCUMENTS

| | | | |
|---|---|---|---|
| 2503634 | 10/1982 | France | 428/913 |
| 54-143152 | 11/1979 | Japan | 346/200 |
| 55-7467 | 1/1980 | Japan | 346/200 |
| 55-152077 | 11/1980 | Japan | 346/200 |
| 55-146790 | 11/1980 | Japan | 346/200 |
| 0030892 | 3/1981 | Japan | 346/200 |
| 56-155794 | 12/1981 | Japan | 346/200 |
| 57-129789 | 8/1982 | Japan | 346/200 |
| 58-171992 | 10/1983 | Japan | 346/200 |
| 58-187396 | 11/1983 | Japan | 346/200 |

OTHER PUBLICATIONS

Patents Abstracts of Japan, vol. 5, No. 108 (M-78) [780], Jul. 14th 1981; & JP-A-56 51 385 (Ricoh K.K.) 08-05-1981.

Patents Abstracts of Japan, vol. 7, No. 98 (M-210) [1243], Apr. 26th 1983; & JP-A-58 20 492 (Ricoh K.K.) 05-02-1983.

*Primary Examiner*—Bruce H. Hess

*Attorney, Agent, or Firm*—Lowe, Price, LeBlanc, Becker & Shur

[57] ABSTRACT

Color sheets for thermal transfer printing comprise a substrate having a colorant layer on one side of the substrate and a resin layer formed on one side of the substrate and a resin layer formed on the other side of the substrate, the resin layer being made of a resin composition comprising fine particles and a lubricating material dispersed in a binder resin. The resin layer is made rough on the surface there of due to the presence of the fine particles whereby the color sheets do not stick to thermal heads and the resulting images are free of drop-out defects and good in quality.

10 Claims, 1 Drawing Figure

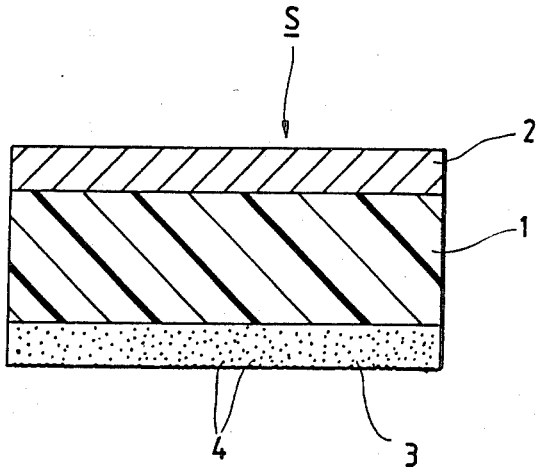
S
2
1
4
3

COLOR SHEETS FOR THERMAL TRANSFER PRINTING

This application is a continuation of application Ser. No. 654,934, filed Sept. 27, 1984, now abandoned.

BACKGROUND OF THE INVENTION

1. Field of the Invention

This invention relates to the art of thermal transfer printing or recording and more particularly, to color sheets for the printing.

2. Description of the Prior Art

Broadly, color sheets for thermal transfer printing can be classified into two groups, one group being a thermal fusion ink transfer sheet and the other group being a sublimable dye transfer sheet. With the latter sheet, a large quantity of thermal energy is essential for sublimating or evaporating dyes. In other words, the thermal energy required for the latter sheet is about 4 to 5 times as large as thermal energy for the former sheet. In order to increase a recording or printing speed of thermal fusion ink systems, it will be necessary to use larger thermal energy per unit time than in existing thermal fusion ink systems.

Substrates suitable for use in color sheets should be thin, uniform in quality, resistant to heat and high in mechanical strength. Materials for such substrates should also be inexpensive. The most suitable substrate currently used in thermal fusion ink transfer systems is a polyethylene terephthalate film. This film cannot be used in sublimable dye transfer systems because of poor heat resistance thereof. When polyethylene terephthalate films are used in recording of high thermal energy as in sublimable dye transfer systems, the film tends to attach to a thermal head of the system electrostatically and/or by thermal fusion, causing a so-called sticking phenomenon with the film being finally broken.

In order to solve the above problem, there have been proposed several types of color sheets using specific types of lubricating materials and heat-resistant resins, or specific types of surface active agents of heat-resistant resins.

In these known color sheets, the anti-stick effect can be achieved to an extent with respect to the thermal fusion ink systems. However, satisfactory results cannot be obtained with regard to the sublimable dye transfer systems. Moreover, because of fine irregularities having a size of several micrometers in the heating elements of thermal heads, the resin layer which contacts with the irregular surface of the heating element is gradually scraped off and accumulated on the heating element. The deposit gives rise to the problem that the resulting image has dropouts where white lines or portions are produced.

SUMMARY OF THE INVENTION

An object of the present invention is to provide color sheets for thermal transfer printing which are suitable for use in sublimable dye transfer systems as well as thermal fusion ink transfer systems of high speed recording.

Another object of the invention is to provide color sheets for thermal transfer printing which have little tendency toward formation of dropouts and are substantially free of sticking to thermal heads.

Color sheets for thermal transfer printing according to the present invention are characterized by a resin layer which is formed on one side of a substrate opposite to a colorant or dye layer-bearing side and which comprises fine particles of a solid material, at least one lubricating material and a polymer resin so that the resin layer is made irregular on the surface thereof due to the presence of the fine particles.

BRIEF DESCRIPTION OF THE DRAWING

A sole FIGURE is a schematic view of a color sheet for thermal transfer printing according to the present invention.

DETAILED DESCRIPTION AND PREFERRED EMBODIMENTS OF THE INVENTION

The color sheets for thermal transfer printing according to the invention comprises a substrate, a colorant layer formed on one side of the substrate, and a resin layer formed on the other side which contacts with thermal heads of recording systems. The resin layer is made of a resin composition which comprises fine particles dispersed in a mixture of a lubricating material and a resin binder. The fine particles are used in amounts sufficient to roughen the surface of the resin layer.

The lubricating materials are added in order to prevent the color sheet from sticking to thermal heads. Fine particles being added serve to prevent formation of dropouts in images. This is because the fine particles added to the resin layer make a rough surface of the resin layer, so that sharp irregularities of the heating element of a thermal head are suitably absorbed by the rough surface, not causing deposition of the resin composition on the heating element. As a result, formation of dropouts can be appropriately prevented, making the best use of the anti-stick effect produced by lubricating materials.

The anti-stick effect can be developed more effectively when using two or more surface active agents, liquid lubricants and solid lubricants in combination.

Reference is now made to the accompanying drawing, in which a color sheet for thermal transfer printing or recording according to the invention is schematically shown. In the drawing, a color sheet, generally indicated by S, includes a substrate 1, and a colorant layer 2 formed on one side of the substrate 1. On the other side of the substrate 1 is formed a resin layer 3 which contains fine particles 4 and a lubricating material dispersed therein. The fine particles are uniformly dispersed in the resin layer 3, so that the surface of the resin layer 3 is made rough or irregular as shown.

The fine particles are not critical with respect to the kind of material and may be made of various materials such as metals, inorganic materials and organic materials. For instance, various metals oxides, metal sulfides, metal carbides, metal nitrides, metal fluorides, graphite, fluorocarbon resins, carbon black, minerals, inorganic salts, organic salts, organic pigments, and polymers such as ethylene tetrafluoride resin, polyimide, etc. may be employed.

Specific and preferable examples of the materials are synthetic amorphous silica, carbon black, alumina, titanium oxide, calcium silicate, aluminium silicate and the like.

Synthetic amorphous silica materials include anhydrous silica and hydrous silica. Anhydrous silica especially useful in the practice of the invention is silica in the form of ultrafine particles which are obtained by vapor phase techniques. This type of amorphous silica was developed by Degsa A.G. West Germany, and is commercially available under the designation of AEROSIL from Nippon Aerosil Co., Ltd. Likewise, ultrafine particles of aluminium oxide or titanium oxide prepared by vapor phase techniques are preferred. These particles are also commercially available from Nippon Aerosil Co., Ltd.

Hydrous silica or white carbon is commercially available, for example, under designations of Carplex from Shionogi & Co., Ltd., Nipsil from Nippon Silica Ind. Co., Ltd., Silton from Mizusawa Industrial Chemicals, Ltd., and Finesil and Tokusil from Tokuyama Soda Co., Ltd.

Silica may react with some types of dyes. In that case, the silanol groups of silica may be partially chemically substituted with methyl group or organic silicon compounds to give hydrophobic silica.

Fine particles are generally used in an amount of from 1.0 to 200 wt % of a resin used. Preferably, the amount ranges from 5 to 100 wt % of the resin. If ultrafine particles are used, they should be sufficiently dispersed in resins by ultrasonic techniques or by means of three-roll mills or homogenizers.

With regard the size of fine particles being added to the resin layer, a smaller size provides less influence on the quality of image. In general, the size is from 0.005 to 0.5 μm, preferably not larger than 6 μm, within which little or no dropouts are produced.

The polymeric resins are not limited to any specific types and may include various thermoplastic resins and various curable resins which are able to be cured by application of heat, actinic light or electron beam. Conveniently, various curable resins are used in view of good adhesiveness and heat resistance. Examples of such curable resins include various silicone resins, epoxy resins, unsaturated aldehyde resins, urea resins, unsaturated polyester resins, alkyd resins, furan resins and oligoacrylates.

Resins which are curable by application of light or electron beam are preferred because they can be readily cured within a short time, so that unreacted resins and curing agents do not substantially transfer to the back side of a substrate, enabling one to fabricate a long color sheet with good characteristics. For these purposes, curable oligoacrylate resins and epoxy resin are conveniently used. Oligoacrylates are curable by application of actinic light or electron beam, and epoxy resins used in combination with aromatic diazonium salts, aromatic iodinium salts or aromatic sulfonium salts as catalysts are curable by irradiation of light.

Examples of the oligoacrylates include polyol acrylates, polyester acrylates, epoxy acrylates, urethane acrylates, silicone acrylates and acrylates of polyacetals. Examples of the epoxy resins include cyclic aliphatic epoxy resins such as vinyl cyclohexene dioxide resin, 3,4-epoxycyclohexylmethyl-3,4-epoxycyclohexane carboxylate resin and the like.

The resins may be admixed with reactive diluents such as tetrahydrofurfuryl acrylate, lauryl acrylate and the like.

The lubricating materials include surface active agents, liquid lubricants and mixtures thereof with or without further addition of solid lubricants.

The surface active agents may be any surface active agents which are known in the art.

Examples of the surface active agents include:

various anionic surface active agents such as carboxylates, sulfonates, sulfates, phosphates and the like;

various cationic surface active agents such as aliphatic amine salts, aliphatic quaternary ammonium salts, aromatic quaternary ammonium salts, heterocyclic quaternary ammonium salts and the like;

various nonionic surface active agents in the form of ethers such as polyoxyethylene alkyl ethers, polyoxyethylene alkylphenyl ethers and the like, ether esters such as polyoxyethylene glycerine fatty acid esters, polyoxyethylene sorbitan fatty acid esters and the like, esters such as polyethylene glycol fatty acid estes, fatty acid monoglycerides, sorbitan fatty acid esters, propylene glycol fatty acid esters, sucrose fatty acid esters and the like, and nitrogen-containing compounds such as fatty acid alkanolamides, polyoxyethylene fatty acid amides, polyoxyethylene alkylamines, alkylamine oxides and the like;

various amphoteric surface active agents such as various betaine compounds aminocaboxylic acid salts, imidazoline derivatives and the like;

various fluorine-containing surface active agents such as fluoroalkyl ($C_2$–$C_{20}$)aliphatic acids, monoperfluoroalkyl ($C_6$–$C_{16}$)ethyl phosphates, perfluorooctanesulfonic acid diethanolamide and the like;

various modified silicone oils such as polyether-modified silicone oils, carboxyl-modified silicone oils, alkylaralkylpolyether-modified silicone oils, epoxypolyether-modified silicone oils and the like; and various silicone surface active agents such as various copolymers of polyoxyalkylene glycols and silicones.

In addition, other surface active agents called high molecular weight surface active agents, organic metal surface active agents and reactive surface active agents may also be used.

Of these, silicone and fluorine-containing surface active agents are preferred. Better anti-static effects are shown when silicone or fluorine-containing surface active agents are used singly or in combination with other surface active agents. Alternatively, two or more surface active agents which have HLB values below 3 and over 3, respectively, or which have HLB values with a difference in value by 3 or more show very remarkable anti-static effects.

Liquid lubricants which may be used in combination with or instead of surface active agents are materials which are liquid at 25° C. under one atmospheric pressure and are lubricating in nature. For example, there are mentioned:

silicone oils such as dimethylpolysiloxane, methylphenylpolysiloxane, methylhydrodienepolysiloxane, fluorine-containing silicone oils and the like;

synthetic oils such as alkylbenzenes, polybutene, alkylnaphthalenes, alkyldiphenylethanes, phosphates and the like; and saturated hydrocarbons, animal and plant oils, mineral oils, glycols such as ethylene glycol, propylene glycol, polyalkylene glycol and the like, glycerine and glycerine derivatives, esters such as butyl stearate, liquid paraffin and the like.

The solid lubricants useful in the present invention are lubricants which are solid or semi-solid at 25° C. under one atmospheric pressure. Examples of such solid lubricants include: various higher alcohols such as stearyl alcohol, mannitol and the like; fatty acids such as stearic acid, montanic acid and the like; fatty acid esters such as stearyl stearate, cetyl palmitate, pentaerythritol tetrastearate and the like; aliphatic hydrocarbons including waxes such as microcrystalline wax, polyolefin waxes and the like, and partial oxides, fluorides and chlorides thereof; fatty acid amides such as palmitic acid amide, ethylenebisstearic acid amide and the like; metallic soaps such as calcium stearate, aluminium stearate and the like; and graphite, molybdenum disulfide, tetrafluoroethylene resin, fluorocarbon resin, talc and the like.

The amount of the lubricating materials including surface active agents, and liquid and solid lubricants depends largely on the type of lubricating material but is generally in the range of 0.1 to 50 wt %, preferably 0.5 to 20, of resin used in the resin layer.

The substrate used in the present invention may be polymer films. Examples of the polymers include polyesters such as polyethylene terephthalate, polyethylene naphthalate, polycarbonates and the like, polyamides such as so-called nylons, cellulose derivatives such as acetyl cellulose, cellulose acetate and the like, fluorine polymers such as polyvinylidene fluoride, tetrafluoroethylenehexafluoropropylene copolymer and the like, polyethers such as polyoxymethylene, polyacetals and the like, polyolefins such as polystyrene, polyethylene, polypropylene, methylpentene polymer and the like, and polyimides such as polyimides, polyimide-amides, polyether imides and the like. Of these, polyester resins are preferable because a thin film can be readily formed and the resins have a certain level of heat resistance and are inexpensive. Polyimides and polyamides which are more resistant to heat than polyesters are very useful especially when color sheets are used repeatedly or in high speed.

In view of the thermal efficiency, the substrate film has generally a thickness of 2 to 30 μm.

The colorant or dye layer which is formed on the side of a substrate opposite to the resin layer-bearing side may be any type of colorant layer ordinarily used in thermal fusion ink systems and sublimable dye transfer systems without limitations. Colorants useful for these purposes may be pigments, dyes and color formers. Sublimable dyes are those dyes which start to sublimate or evaporate at temperatures below 300° C. Typical examples of such sublimable dyes include basic dyes and disperse dyes having the following formulae. These colorants are preferably used in combination with binder resins as is well known in the art.

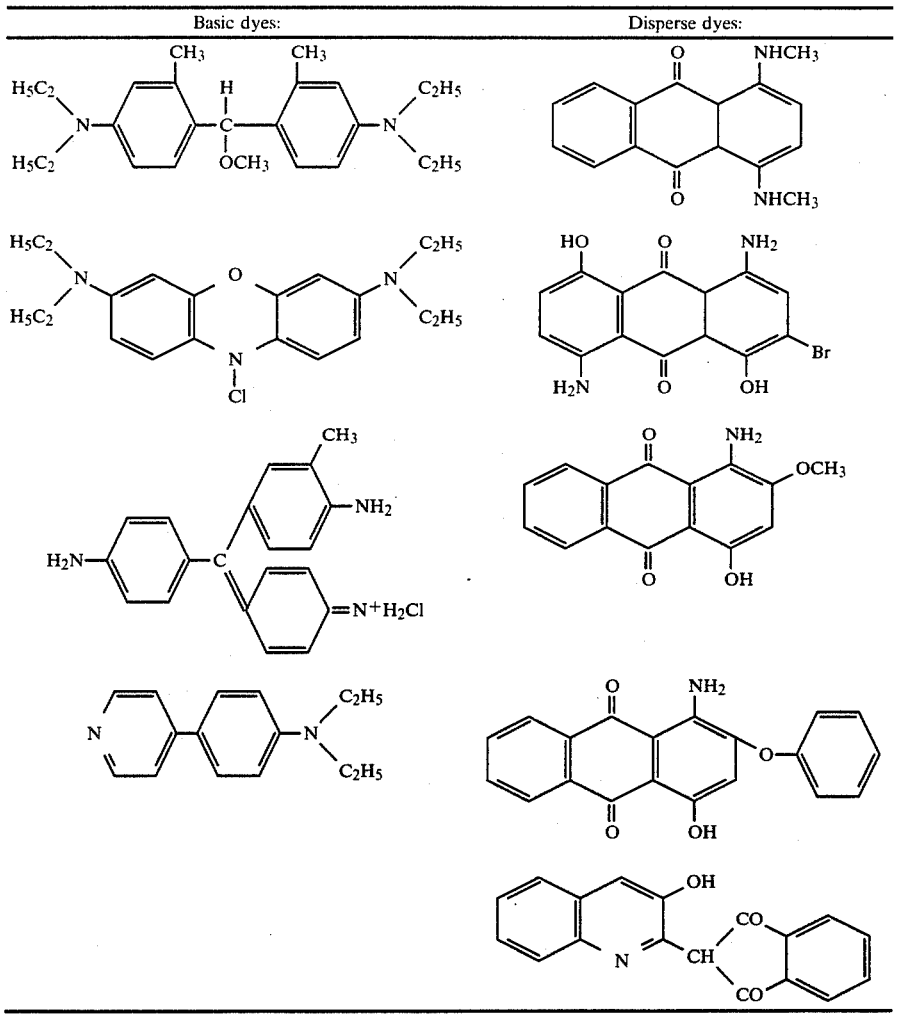

In fabrication of color sheets for thermal transfer printing according to the invention, a resin composition and a colorant composition are separately prepared and are, respectively, applied to a polymer film substrate on opposite sides thereof, followed by curing or drying to form a colorant layer on one side of the substrate and a resin layer on the opposite side of the substrate as usual, which will be more particularly described in examples appearing hereinafter.

For the preparation of the resin composition and colorant composition, solvents are used to dissolve resin components or disperse solid particles. Solvents should be properly used depending on the types of resin, colorant and lubricating material. Various solvents are usable in the practice of the invention, including aromatic hydrocarbons, esters, ketones, ethers, sulfones and the like.

In order to form a resin layer from a resin composition, the resin composition is applied onto one side of a substrate by any known techniques such as roll coating, blade coating, spray coating and the like. The applied composition is subsequently dried at suitable temperatures of 50° to 160° C. to remove the solvent therefrom and cured using actinic light, heat or electron beam which depends on the type of curable resin.

The resin layer is not critical with respect to the thickness thereof and is generally in the range over 0.1 μm, inclusive, from the standpoint of ease in formation and is preferred to be in the range of 0.2 to 10 μm.

The present invention is particularly described by way of examples.

EXAMPLE 1

A 12 μm thick polyethylene terephthalate film was provided as a substrate. Resin compositions Nos. 1 through 4 having the formulations indicated in Table 1 were prepared.

Each of the resin compositions was applied on one side of the substrate and dried by hot air of 60° C. to remove the solvent by evaporation, followed by curing by irradiation with a 1 KW high pressure mercury lamp. Thus, four polyethylene terephthalate films having four different resin layers on one side of the films were obtained.

Subsequently, there was prepared an ink composition having 2 parts by weight of a sublimable dye having the following formula, 4 parts by weight of polycarbonate and 100 parts by weight of methylene chloride. The ink composition was applied onto the opposite side of each film substrate by means of a wire rod and dried with hot air of 60° C. to obtain four color sheets.

The respective color sheets were used for recording on an active clay-coated paper with an A-5 size using a thin thermal head under the following recording conditions.

Main and sub scanning line densities: 4 dots/mm
Recording power: 0.7 W/dot
Heating time of the head: 2–8 ms.
Recording time for one line: 33.3 ms.
Recording area: A-5 size The test results are shown in Table 1. The color sheets using the resin composition Nos. 1 and 2 according to the invention did not cause any sticking phenomenon and did not produce any dropouts in the images. On the other hand, the color sheet using the resin composition No. 3 for comparison stuck to the thermal head in 3 milliseconds and broke by fusion, making it impossible to evaluate dropout defects. The color sheet using the resin composition No. 4 for comparison produced a dropout defect, where white lines (non-printed portions) were formed on images, on the first A-5 size paper.

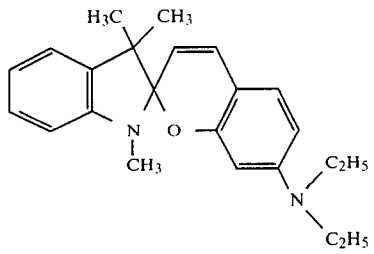

Table 1

Resin Composition and Test Results

| No. | Resin Composition: Ingredients | Weight (g) | Test Results: Occurrence of Sticking | Test Results: Occurrence of Dropouts |
|---|---|---|---|---|
| | Compositions of Invention | | | |
| 1 | epoxy acrylate resin (viscosity: 150 poises) | 20 | no sticking | no dropout |
| | 2-hydroxy-2-methyl-propiophenone as sensitizer | 1.0 | | |
| | $TiO_2$; (P25: Nippon Aerosil Co., Ltd) | 4.0 | | |
| | oleic monoglyceride | 0.4 | | |
| | surface active agent (L7500: Nippon Unicar Co., Ltd.) | 1.6 | | |
| | ethyl acetate | 100 | | |
| 2 | polyester acrylate (viscosity: 800 poises) | 20 | no sticking | no dropout |
| | sensitizer (same as in No.1) | 1.0 | | |
| | carbon black (particle size: 460 angstrom) | 4.0 | | |
| | sorbitan trioleate | 0.1 | | |
| | sorbitan monopalmitate | 0.1 | | |
| | surface active agent (L7500) | 1.6 | | |
| | toluene | 20 | | |
| | ethyl acetate | 80 | | |
| | Comparative Compositions | | | |
| 3 | polyester acrylate resin (800 poises) | 20 | stuck in 3 ms. | not evaluated because of the sticking |
| | sensitizer (same as used in No. 1) | 1.0 | | |
| | ultrafine hydrous silicate (Silton R2: Mizusawa Ind. Chem. Ltd.) | 4.0 | | |
| | ethyl acetate | 100 | | |
| 4 | polyester acrylate resin (800 poises) | 20 | no sticking | dropout produced on the first paper |
| | sensitizer (same as used in No. 1) | 1.0 | | |
| | stearyl stearate | 0.2 | | |
| | surface active agent (L7500) | 2.0 | | |
| | toluene | 20 | | |
| | ethyl acetate | 80 | | |

EXAMPLE 2

A 9 μm thick polyethylene terephthalate film was provided as a substrate. Resin compositions having the formulations indicated in Table 2 were prepared according to the present invention, in which resin composition No. 5 contained, aside from the solvent and sensitizer, fine particles, a liquid lubricant, a surface active agent and a polymer resin. Likewise, resin composition No. 6 contained fine particles, a solid lubricant, a surface active agent and a polymer resin. Resin composition No. 7 contained fine particles, a liquid lubricant, a solid lubricant, a surface active agent and a polymer resin.

These resin compositions were each applied onto a substrate on one side thereof in the same manner as in Example 1 to form a resin layer thereon. On the opposite side of each of the resulting substrates was formed a colorant layer having the formulation indicated in Example 1 to obtain three color sheets.

These sheets were each subjected to the tests for checking sticking and dropout defects in the same manner as in Example 1 except that the recording power was raised to 0.77 W. The test results are shown in Table 2. No sticking phenomenon occurred under severe conditions of 0.77 W and 8 milliseconds and no dropout defects were produced.

TABLE 2

Resin Compositions and Test Results

| Resin Composition | | | Test Results | |
|---|---|---|---|---|
| No. | Ingredients | Weight (g) | Occurrence of Sticking | Occurrence of Dropouts |
| 5 | epoxy acrylate resin | 20 | no | no |
| | 2-hydroxy-2-methyl-propiophenone as sensitizer | 1.0 | | |
| | $SiO_2$ (300: Nippon Aerosil Co., Ltd.) | 4.0 | | |
| | silicone oil | 0.2 | | |
| | surface active agent (L7500) | 1.0 | | |
| | ethyl acetate | 100 | | |
| 6 | epoxy acrylate resin | 20 | no | no |
| | sensitizer (same as in No. 1) | 1.0 | | |
| | $SiO_2$ (same as in No. 5) | 4.0 | | |
| | stearyl stearate | 0.1 | | |
| | surface active agent (L7500) | 1.0 | | |
| | toluene | 20 | | |
| | ethyl acetate | 80 | | |
| 7 | epoxy acrylate resin | 20 | no | no |
| | sensitizer (same as used in No. 5) | 1.0 | | |
| | aluminium oxide C (Nippon Aerosil Co., Ltd.) | 4.0 | | |
| | silicone oil | 0.2 | | |
| | stearyl stearate | 0.1 | | |
| | surface active agent (L 7500) | 1.0 | | |
| | toluene | 20 | | |
| | ethyl acetate | 80 | | |

As will be apparent from the above examples, the color sheets according to the invention do not involve any dropout defects and sticking phenomenon even when polyethylene terephthalate films are used as the substrate of color sheets for sublimable dye transfer systems, thus enabling one to provide stable images of high quality inexpensively.

What is claimed is:

1. A color sheet for thermal transfer printing which comprises a polymer film substrate having a colorant layer on one side thereof, and a resin layer having a roughened outer surface formed on the opposite side of said film substrate, said resin layer being made of a composition which comprises a cured resin binder, 5.0 to 100 wt % of fine particles of a heat-resistant solid material having an average size of from 0.005 to 0.5 micrometers and 0.1 to 50 wt % of a liquid lubricant dispersed throughout the resin binder, both based on the resin binder, said resin layer being made rough on the outer surface thereof by the fine particles.

2. The color sheet according to claim 1, wherein said fine particles are made of a material selected from the group consisting of carbon black, synthetic amorphous silicon oxide, aluminium oxide, titanium oxide, calcium silicate and aluminium silicate.

3. The color sheet according to claim 1, wherein said liquid lubricant comprises at least one surface active agent.

4. The color sheet according to claim 3, wherein said surface active agent is a silicone or fluorine-containing surface active agent.

5. The color sheet according to claim 1, wherein said liquid lubricant comprises a mixture of at least two surface active agents having HLB values below and over 3, respectively.

6. The color sheet according to claim 1, wherein said liquid lubricant comprises a mixture of at least two surface active agents which have HLB values with a difference in value of 3 or larger.

7. The color sheet according to claim 1, wherein said resin binder is a resin curable with actinic light.

8. The color sheet according to claim 1, wherein said resin binder is a curable oligoacrylate.

9. The color sheet according to claim 1, wherein a colorant in said colorant layer is a sublimable dye.

10. A color sheet for thermal transfer printing which comprises a polymer film substrate having a colorant layer on one side thereof, and a resin layer having a roughened outer surface formed on the opposite side of said film substrate, said resin layer being made of a composition which comprises a cured resin binder, 5.0 to 100 wt % of fine particles selected from the group consisting of carbon black, synthetic amorphous silicon oxide, aluminum oxide, titanium oxide, calcium silicate and aluminum silicate, said particles having an average size of from 0.005 to 0.5 micrometers and 0.1 to 50 wt % of a liquid lubricant dispersed throughout the resin binder, both based on the resin binder, said resin layer being made rough on the outer surface thereof by the fine particles.

* * * * *